United States Patent [19]

Tudbury

[11] 4,207,451

[45] Jun. 10, 1980

[54] MULTI-LAYERED ELECTRICAL INDUCTION COIL SUBJECTED TO LARGE FORCES

[75] Inventor: Chester A. Tudbury, White Plains, N.Y.

[73] Assignee: Thermatool Corporation, Stamford, Conn.

[21] Appl. No.: 885,483

[22] Filed: Mar. 13, 1978

[51] Int. Cl.[2] ..... H05B 5/18

[52] U.S. Cl. ..... 219/10.79; 219/10.49 R; 336/177

[58] Field of Search ..... 219/10.79, 7.5, 8.5, 219/9.5, 10.43, 10.49; 336/177, 222

[56] References Cited

U.S. PATENT DOCUMENTS

| | | | |
|---|---|---|---|
| Re. 29,016 | 10/1976 | Peacock | 219/7.5 |
| 1,891,481 | 12/1932 | Scofield | 336/177 |
| 2,572,646 | 10/1951 | Menzel et al. | 219/10.53 |
| 2,596,770 | 5/1952 | Groven | 219/10.79 |
| 3,088,200 | 5/1963 | Birdsall et al. | 219/7.5 |
| 3,126,937 | 3/1964 | Brower et al. | 219/7.5 |
| 3,258,573 | 6/1966 | Morin et al. | 219/7.5 |
| 3,612,806 | 10/1971 | Lewis | 219/10.79 |
| 3,755,644 | 8/1973 | Lewis | 219/10.79 |
| 3,764,944 | 10/1973 | Erven | 336/222 |
| 3,900,695 | 8/1975 | Andersson et al. | 219/10.79 |

OTHER PUBLICATIONS

Reference Depth, Tudbury, "Basics of Induction Heating", vol. 1, pp. 44–45, 1960.

*Primary Examiner*—Bruce A. Reynolds
*Assistant Examiner*—Philip H. Leung
*Attorney, Agent, or Firm*—Brooks, Haidt, Haffner & Delahunty

[57] ABSTRACT

An induction coil for the treating of metal parts where the coil carries large currents and is subjected to large forces. The coil has two layers of metal, the layer nearest the metal part being made of high conductivity and the other layer being made of a metal having an electrical conductivity less than that of copper and having a Young's Modulus at least 20% greater than the Young's Modulus of the metal of the layer nearest the metal part. The layer of metal nearest the metal part has a thickness at least equal to the reference depth of the current in such metal and preferably, has a thickness from 1.5 to 10 times such reference depth. Preferably, also, the surfaces of the other layer, except possibly those relatively remote from the principal currents, are covered by the high conductivity metal having a thickness at least equal to such reference depth.

13 Claims, 19 Drawing Figures

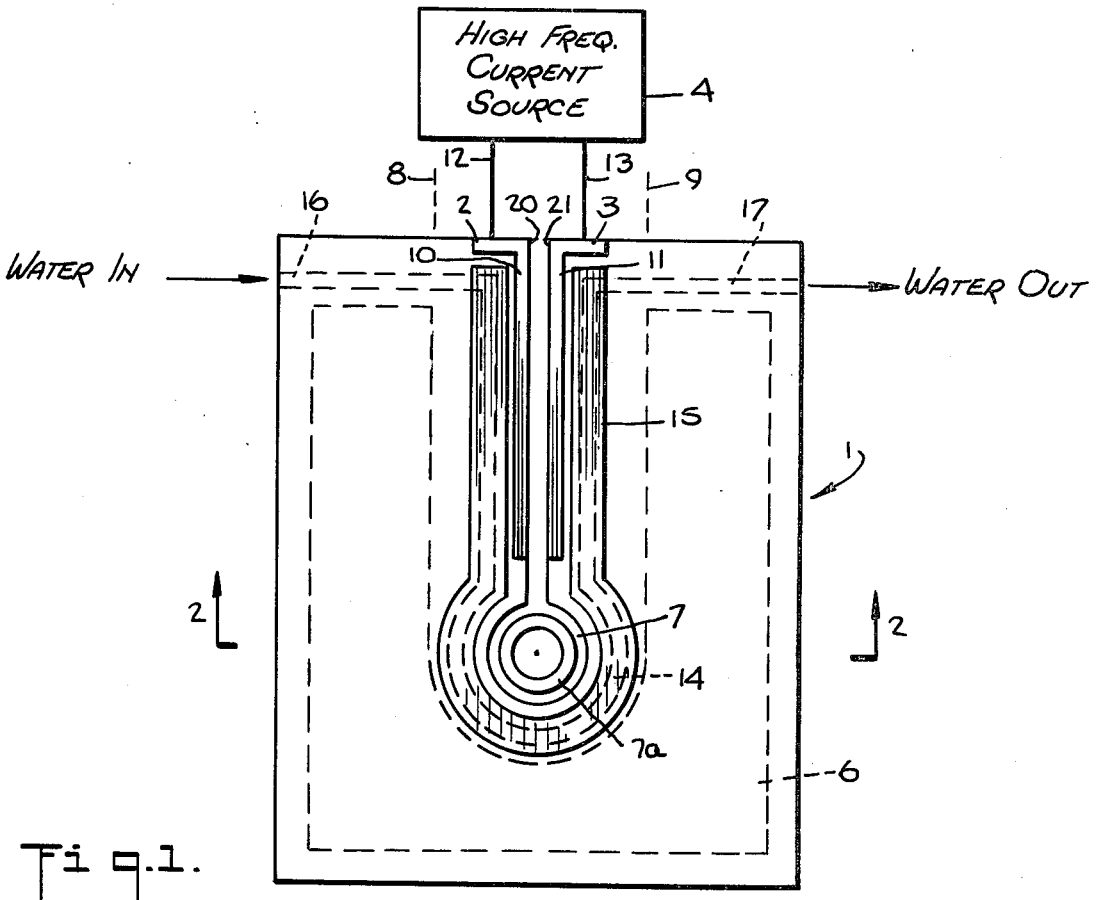
Fig. 1.
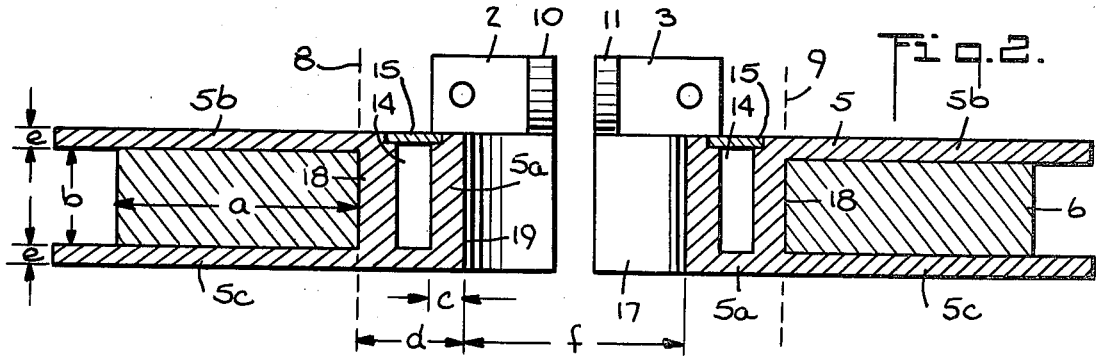
Fig. 2.
Fig. 3.
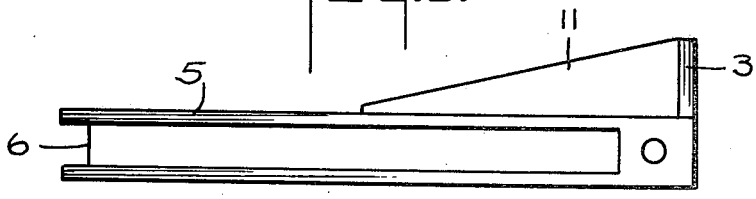

Fig. 4.
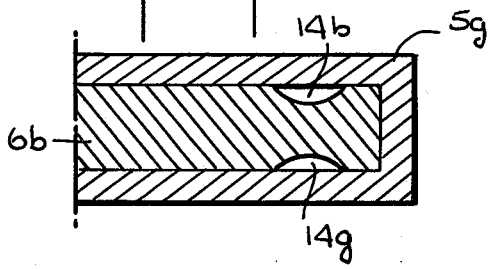
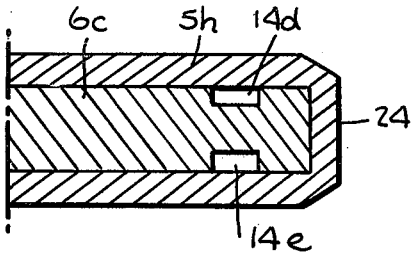
Fig. 5.
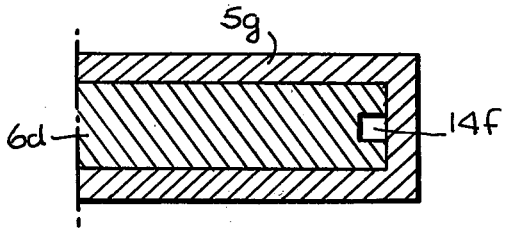
Fig. 6.
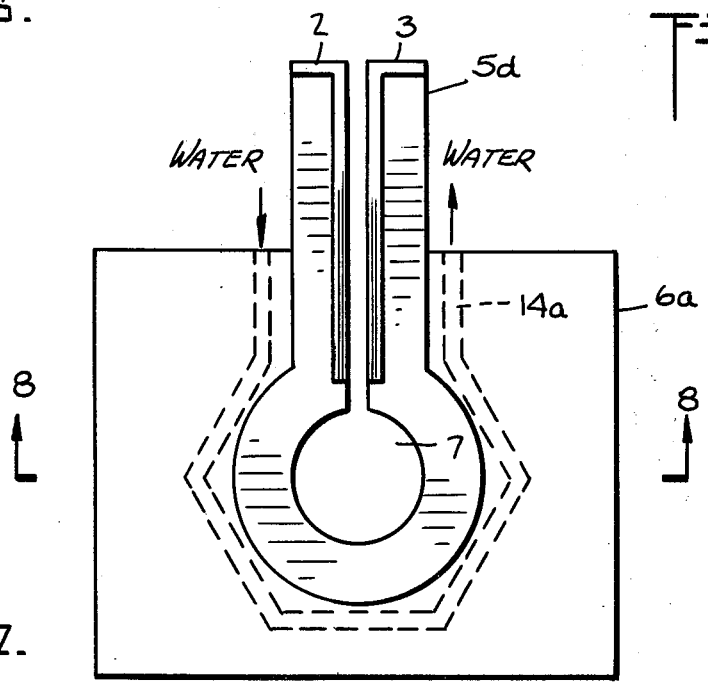
Fig. 7.
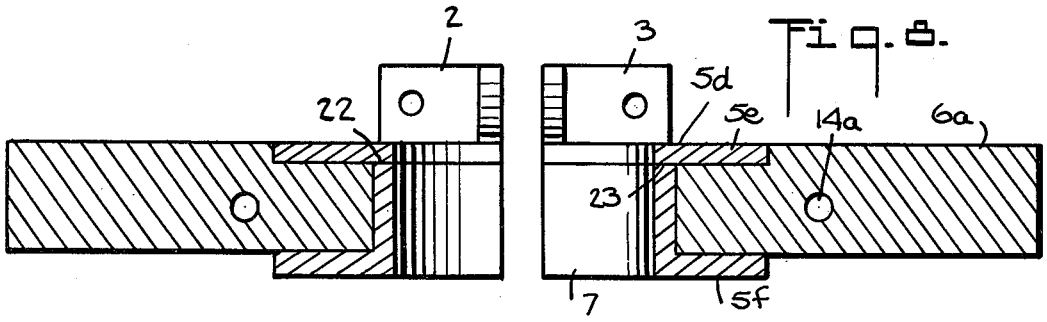
Fig. 8.

Fig.11.
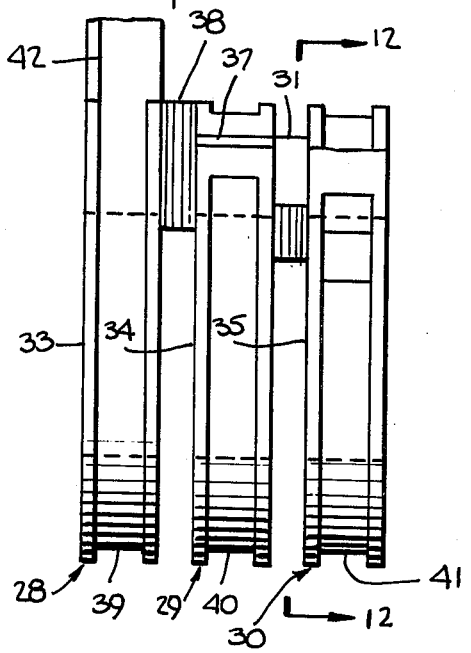
Fig.12.
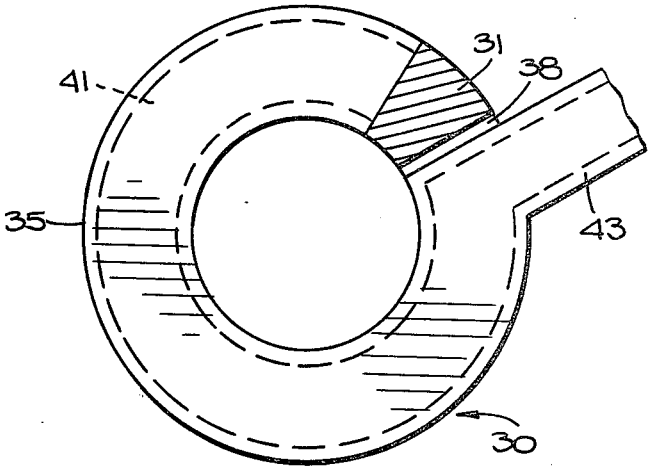
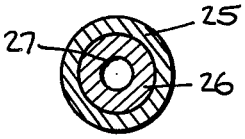
Fig.10.
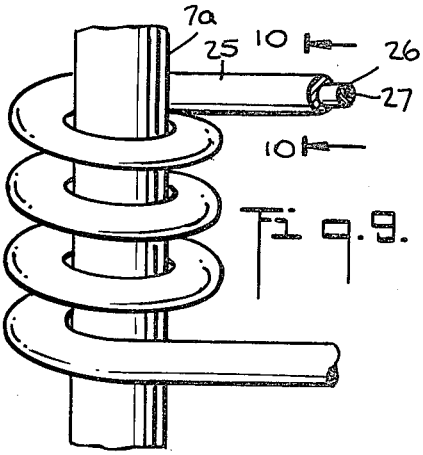
Fig.9.
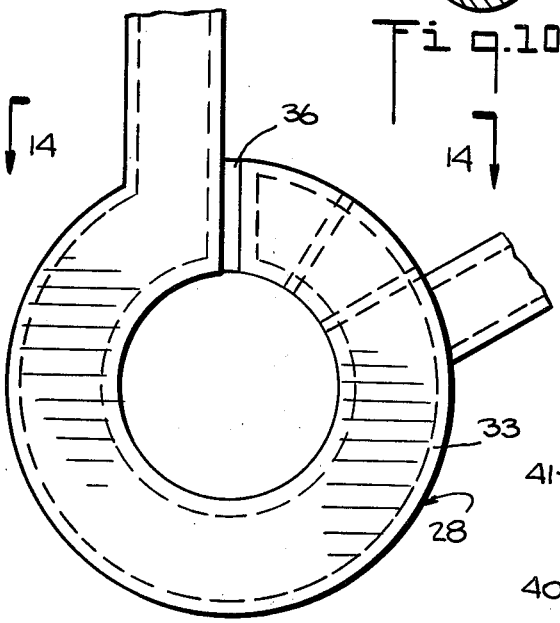
Fig.13.
Fig.14.
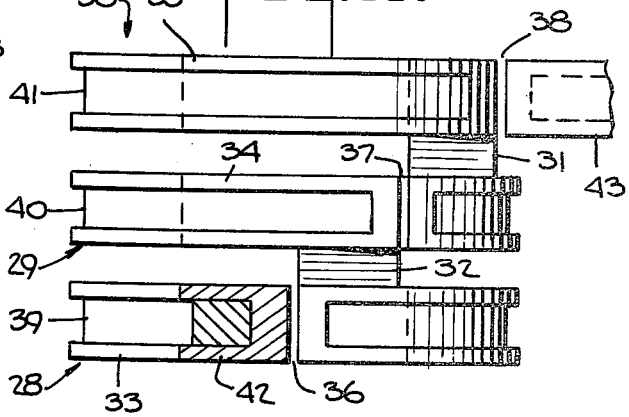

Fig. 15.
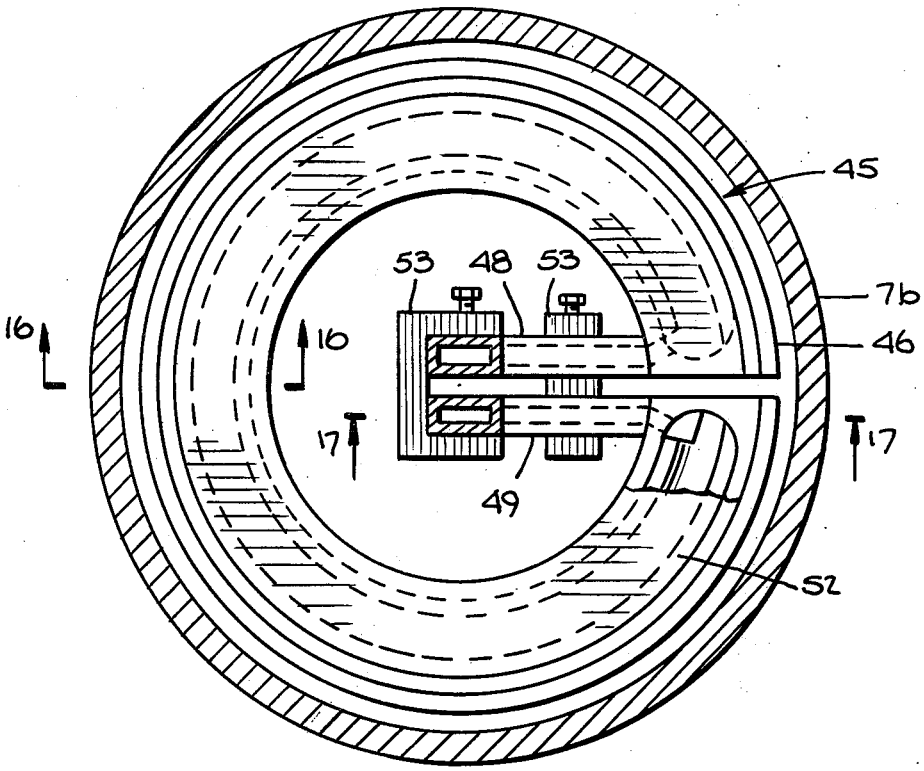
Fig. 16.
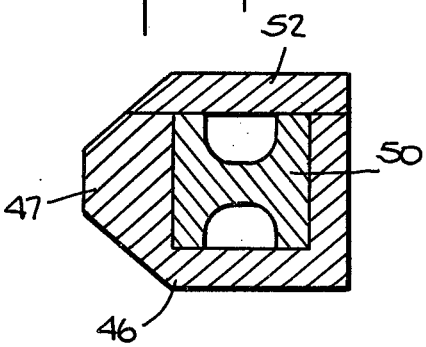
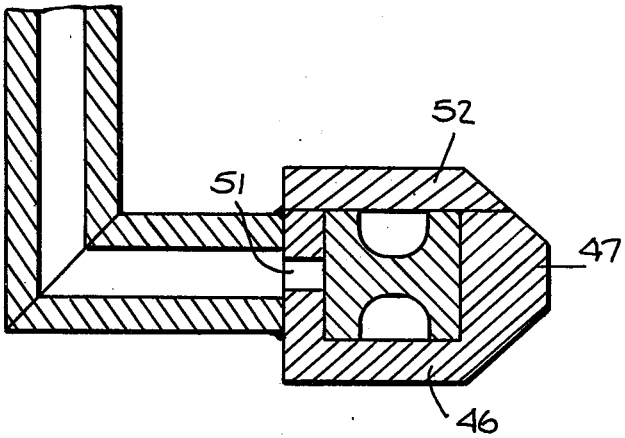
Fig. 17.

MULTI-LAYERED ELECTRICAL INDUCTION COIL SUBJECTED TO LARGE FORCES

This invention relates to induction coils intended to carry relatively large electric currents, such as coils of the type used in the magnetic forming or pressing together of metal parts.

Apparatus and methods for the forming or pressing together of metal parts by large magnitude magnetic fields which induce relatively large electric currents in the parts are well-known in the art. See, for example, U.S. Pat. Nos. 3,088,200; 3,126,937; 3,258,573 and RE. 29,016. Such apparatus and methods usually involve a metal coil of one or more turns to which a direct current source is connected when the metal parts are to be formed or pressed together. The source is of the type which supplies a large magnitude pulse of current of short duration to the coil and usually involves the discharge of at least one capacitor. The shape of the current pulse is a damped oscillatory wave which, as is known, is effectively a high frequency current.

In such apparatus and methods, the coil must withstand forces directed radially outwardly thereof of the same order of magnitude as the forces applied to the metal parts to be formed or pressed together. The practice has been to make the coil of a massive block of copper which, in some cases, is re-enforced by insulating material. Copper, is not, of course, able to withstand high bending forces, and problems have been encountered with coil destruction and deformation.

Metal coils are also employed for induction heating which may also involve the flow of very large currents in the coil, for example, when the heating is to be accomplished in a very short time. Similar forces tending to deform the coil are encountered in such heating.

Copper is usually employed for the coil because of its high electrical conductivity, but the large mass of copper which is relatively expensive, is employed for mechanical rather than electrical reasons. Generally speaking, most of the current is concentrated in the paths in the coil which are closest to each other and on the surface of the coil due to various effects including proximity and skin effects.

Also, because of the large currents involved and the heating effects thereof, provisions are made to cause a cooling fluid, such as water, to flow inside the coil. The passages in the coil which provide for such cooling fluid also create weak spots in the coil structure relative to the remainder of the structure.

One object of the invention is to provide a coil for use in the forming, heating for pressing together of metal parts which has the ability to withstand for a substantial period of use very high forces tending to deform it, which has electrical characteristics substantially as good as a coil made entirely of a high conductivity metal, such as copper, and which uses much less of such high conductivity metal. A coil made in accordance with the invention may also be smaller than a coil made entirely of copper and of a size sufficient to withstand the deforming forces in a given installation.

The coil of the invention comprises a core of a high strength, lower electrical conductivity metal, such as steel, either magnetic or non-magnetic, having thereon a layer of a higher conductivity metal, such as copper, which is so disposed and is of such thickness that at least about 89% of the current which flows in the coil and produces the desired magnetic field flows in the high conductivity metal portion of the coil. In order to be effective for the purposes of the invention, the Young's Modulus of elasticity of the core metal must be greater than the Young's Modulus of the high conductivity metal, e.g. at least 20% greater and preferably higher. In the preferred embodiment of the invention, passageways for cooling fluid are provided mainly in the core so as to eliminate weak spots in the high conductivity portion of the coil structure.

Other objects and advantages of the present invention will be apparent to those skilled in the art from the following detailed description of presently preferred embodiments, which description should be considered in conjunction with the accompanying drawings in which:

FIG. 1 is a plan view of an embodiment of the coil of the invention connected to a current source;

FIG. 2 is an enlarged, cross-sectional view of the coil shown in FIG. 1 and is taken along the line 2—2 indicated in FIG. 1;

FIG. 3 is a side elevation view of the coil shown in FIG. 1;

FIGS. 4–6 are fragmentary cross-sectional, elevation views of modified forms of portions of the embodiment shown in FIG. 1;

FIG. 7 is a plan view of a modified form of the embodiment shown in FIG. 1;

FIG. 8 is a cross-sectional view of the embodiment shown in FIG. 7 and is taken along the line 8—8 indicated in FIG. 7;

FIGS. 9 and 10 are, respectively, plan and cross-sectional views of a multi-turn coil of the invention;

FIG. 11 is a side elevation view of another multi-turn coil of the invention;

FIG. 12 is an end elevation view, partly in cross-section, of a turn of the coil shown in FIG. 11;

FIGS. 13 and 14 are, respectively, end and plan views of the coil shown in FIG. 11;

FIG. 15 is a plan view of an internal coil of the invention adjacent apart to be treated;

Figure 18:
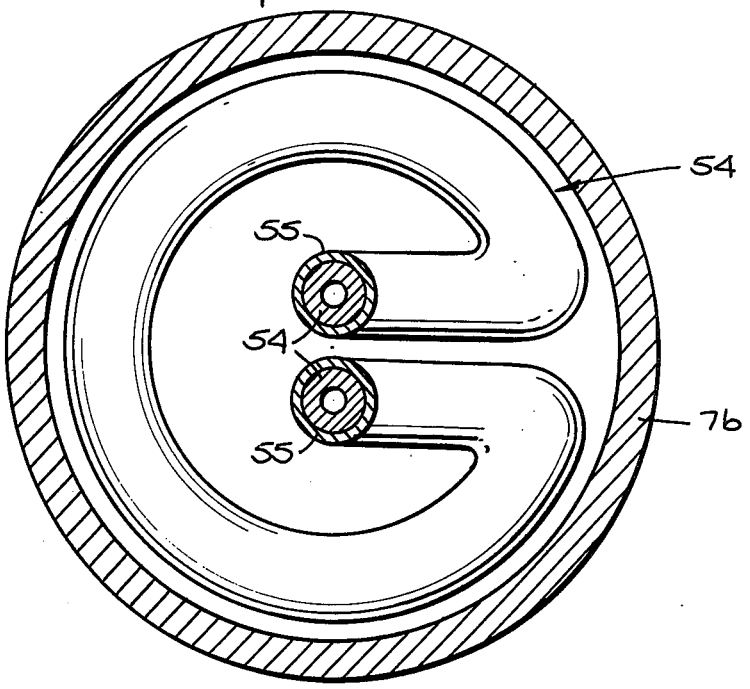
Figure 19:
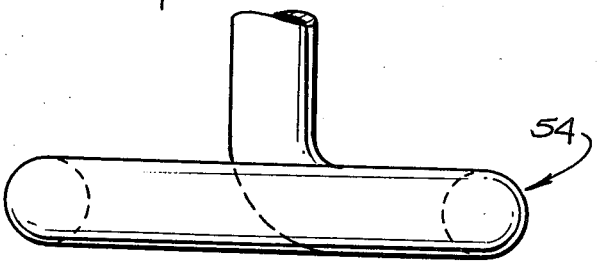

FIGS. 16 and 17 are fragmentary, cross-sectional views of the coil shown in FIG. 15 and are taken, respectively, along the lines 16—16 and 17—17 indicated in FIG. 15;

FIG. 18 is a plan view of another embodiment of an internal coil of the invention adjacent FIG. 19 is a side elevation view of the coil shown in FIG. 18.

FIGS. 1–3 illustrate a single turn coil 1 of the invention electrically connected at its ends 2 and 3 to a current source 4. The source 4 may be a direct current source of the type previously described which provides a pulse of current which may be considered a high frequency current or may be an alternating current source. As used herein, the word "coil" means either a loop or turn of metal which extends nearly 360° around a point, as shown in FIG. 1, or a loop or turn of metal which extends more than 360° around such point.

In the embodiment of the coil 1 illustrated in FIGS. 1–3, the coil 1 comprises a first portion 5 made of high electrical conductivity metal, preferably copper, and a second portion 6 made of a different metal, such as steel. The portion 5 may be machined from a block of copper because even if the copper removed is wasted, the amount of copper required may be less than the copper required if it is solely relied upon to provide the necessary resistance to deformation. However, if desired, the portion 5 may be made of separate parts brazed together. For example, the central portion 5a which defines the opening 7 for receiving a metal part 7a to be heated, formed, etc. and provides connections to the source 4 may be made in one piece, terminating at its outer sides along the lines 8 and 9 and the outer portions 5b and 5c may be a pair of suitably formed plates secured to the central portion 5a by brazing along the lines 8 and 9.

The first portion 5, in addition to the portions 5a, 5b and 5c, preferably, includes a pair of supporting gussets 10 and 11, and a pair of upstanding terminal ends 2 and 3 which may be bolted to leads 12 and 13 extending from the source 4 to the ends 2 and 3. Although, as described hereinafter, it is preferred to provide a cooling channel, e.g. for the flow of cooling water, in the second portion 6 of the coil 1, the first portion 5 may have a cooling channel 14 formed therein, such channel 14 being covered by a copper plate 15 secured to the portion 5 such as by brazing. Opposite ends of the channel 14 are connected by tubing 16 and 17 to a cooling fluid source, e.g. a water source (not shown).

The second portion 6 normally is made in one piece and provides the desired mechanical strength. In the embodiment shown, the portion 6 is U-shaped and firmly engages the side 18 of the portion 5a which is opposite from the side 19 thereof which defines the opening 7.

The second portion 6 is made of a metal different from the metal of the first portion 5 and need not be made of a metal having high electrical conductivity for the reasons explained hereinafter. The metal of the second portion 6 must have a Young's Modulus higher than that of the metal of the first portion 5 in order to obtain the advantages of the invention, and preferably the Young's Modulus of the metal of the portion 6 should be at least 20% higher than the Young's Modulus of the metal of the portion 5 in order to obtain significant advantages. Typical Young's Modulus values for various metals are as follows:

| Metal | Young's Modulus $\times 10^6$p.s.i. |
|---|---|
| copper | 15.6 |
| aluminum | 9.9–10.3 |
| cast steel | 28.5 |
| cold-rolled steel | 29.5 |
| stainless steel | 27.6 |
| other steels | 28.6–30.0 |
| Inconel | 31 |
| molybdenum | 48–52 |

Accordingly, there are many metals which can be used for the second portion 6, and all steels are satisfactory.

Generally speaking, the dimensions of the second portion 6 are selected, in a manner known to those skilled in the art, so that coil 1 will be useful for a substantial period of time with the forces applied to it by the passage through the coil 1 of the current of the magnitude desired for a given installation, and the dimensions of the first portion 5 are selected to provide the desired electrical characteristics. Thus, the combined resistance of the portions 5 and 6 to deformation is such that the coil 1 will be useful for a substantial period of time, even though there may be some deformation of the portion 5, and the electrical characteristics are obtained by the construction and dimensions of the portion 5 as described hereinafter.

It should be noted that with the coil construction of the invention, the coil will maintain its shape, in a general sense, for a large number of applications of the heating, shaping or forming current, but because the metal of the portion 5 is relatively formable, each application of the current may produce a slight change in the shape of the metal of the portion 5 which is exposed to the forces produced, such as the metal facing the part 7a. This is also true of a coil which is made entirely of copper and which can withstand the forces at least initially, but after a period of time the high conductivity metal, e.g. copper, may become distorted sufficiently to require replacement of the coil even though the portion 6 may retain its shape. However, using the principles of the invention, the coil will have a life which is economically practical and at least as good as a coil made entirely of the high conductivity metal and for coils of a given size, the coil of the invention will be able to withstand repetitive currents of larger magnitude than a coil made entirely of the high conductivity metal.

In a coil of the invention, the high conductivity metal is between the part 7a being treated and the portion 6, and therefore, for distortion reduction reasons, it is desireable to keep the high conductivity metal as thin as possible consistent with the electrical requirements hereinafter described.

As one example of the principal dimensions of a coil 1 capable of carrying a capacitor discharge current having a maximum instantaneous value of 200,000 amperes with a frequency of 10 kilohertz without deformation, of a magnitude which will prevent its continued use for a relatively long period of time, the following are given (see FIG. 2):

| Dimension | Inches |
|---|---|
| a | 1¾ |
| b | ½ |
| c | ¼ |
| d | ¾ |
| e | ¼ |
| f | 13/16 |

The portion 5 is made of copper, and the portion 6 is made of cold rolled steel.

The coil of the invention does not have electrical losses significantly different from a similar coil made entirely of high conductivity metal. With the coil construction shown in FIGS. 1–3, the reason for this is the fact that 89% of the current flows within the reference depth so that it is necessary to have high conductivity metal in the path of the current which is at least as thick as the reference depth and, preferably, one-and-one-half times the reference depth. The metal outside the reference depth path will have little effect on the losses even if such metal has a relatively low electrical conductivity.

A further reason for low electrical losses with the coil construction of FIGS. 1–3 is the well-known proximity effect between currents flowing in opposite directions, such effect increasing with current frequency and with a decrease in the spacing between the conductors carrying the currents. Proximity effect is very small when the spacing between the conductors is of the order of five or more times the width of the conductors in the direction perpendicular to the direction of current flow. The proximity effect causes a change in current distribution from the distribution which would occur without the proximity effect, and the case of the coil 1, the lowest impedance paths for the currents would be within the metal of reference depth thickness at the facing surfaces 20 and 21 of the metal of the portion 5 which extends from the ends 2 and 3 to the part of the first portion 5 which defines the opening 7. Therefore, if the spacing between the surfaces 20 and 21 is relatively small as compared to the width of the surfaces 20 and 21, and the current frequency is relatively high, very little current will flow in areas of the first portion 5 other than at the surfaces 20 and 21 and in the wall 19 defining the opening 7. For these reasons, the thickness c of the portion 5*a*, both around the opening 7 and from the opening 7 to the ends 2 and 3 need only be equal to the current reference depth in the metal of the first portion 5. However, because some current does flow in the metal at a depth greater than the reference depth, it is preferable that the thickness c be at least one-and-one-half the reference depth, but if some of the electrical losses can be tolerated and it is desired to take maximum advantage of the principles of the invention, the thickness c may be between the reference depth and one-and-one-half times the reference depth. In any event, the thickness c should be no more than about ten times the reference depth.

The invention is applicable mainly to cases where the current supplied by the source 4 is a high frequency current, e.g. of 3 KhZ or higher because, in such cases, the high conductivity metal may be relatively thin. For example, reference depth is defined by the formula:

$$d \text{ inches} = 3160\sqrt{p/uf}$$

where p is the resistivity of the metal in ohm inches, u is the relative magnetic permeability and f is the frequency in hertz. It will be noted that the reference depth decreases with frequency, and reference depth is sometimes referred to as the depth in which 89.4% of the current flows and 80% of the heat is produced. Typical reference depths, in thousanths of an inch, for the high electrical conductivity metals, copper and aluminum, at 70° F. are as follows:

| | Frequency - kilohertz | | | | |
|---|---|---|---|---|---|
| Material | 0.06 | 3 | 10 | 100 | 400 |
| copper | 336 | 85 | 26 | 8 | 5 |
| aluminum | 430 | 110 | 33 | 10 | 5 |

It will be apparent from the foregoing that at 60 hertz electrical requirements dictate relatively thick parts of copper or aluminum, and unless very large currents are involved, the improvement of the invention may not be required or a coil made entirely of one metal, e.g. copper or aluminum, may be more economical. On the other hand, coil stresses are relatively high at low frequencies, and even though relatively thick parts of the high conductivity may be required to keep the electrical losses low, the coil of the invention may be desirable because of its ability to resist repetitive stresses over a relatively long period of time without deformation which makes the coil no longer usable as compared to a coil made entirely of the high conductivity metal. However, at high frequencies, i.e. 3 KhZ or higher, the high conductivity parts may be relatively thin insofar as electrical requirements are concerned, but such parts would have insufficient mechanical strength for use with more than relatively small currents.

A coil 1 made entirely of a low conductivity metal, such as steel, would not be satisfactory because of the electrical losses. Silver and gold, in addition to aluminum and copper, have a high electrical conductivity, and it has been known to plate copper conductors with gold or silver to decrease the resistance thereof or for other reasons. It also is known in the art that the silver plating of the turns of a coil made of copper tubing will decrease the losses therein, but because of the low strength of silver, such a coil would have the disadvantages of an all copper coil described hereinbefore. While gold or silver could be used for the first portion 5, the use thereof would be uneconomical, and if copper or aluminum were used for the second portion 6, the advantages of the invention would not be obtained. Accordingly, the metal of the second portion 6 of the coil 1 should have at least an electrical conductivity less than that of copper and a Young's Modulus at least 20% greater than the Young's Modulus of the metal of the portion 5. Preferably, the Young's Modulus of the metal of the portion 6 should be at least 20% greater than the Young's Modulus of copper, i.e. at least $18.7\times10^6$ p.s.i.

Because the coil 1 produces a varying magnetic field, it is preferable to cover the upper and lower sides of the second portion 6 with the high conductivity portions 5*b* and 5*c* to keep electrical losses in the second portion to a minimum. The thickness e of such portions 5*b* and 5*c* should be at least equal to the reference depth and preferably is at least one-and-one-half times the reference depth but not greater than ten times the reference depth. However, if the losses in the portion 6 can be tolerated, the portions 5*b* and 5*c* may be omitted or reduced in size so that the portion 6*a* extends outwardly thereof. A so-modified form of the coil is illustrated in FIGS. 7 and 8, the embodiment in FIGS. 7 and 8 also having the fluid cooling channel 14*a* located in the second portion 6*a*. Also, in the embodiment shown in FIGS. 7 and 8, the first portion 5*d* is made of two high conductivity metal parts 5*e* and 5*f* secured together by brazing along their meeting surfaces 22 and 23. The amount by which the parts 5*e* and 5*f* overlap the portion 6 depends upon the electrical losses which can be tolerated, but the width of the parts 5*e* and 5*f*, as viewed in FIG. 8, should be at least equal to the reference depth and preferably, should be several times, e.g. at least ten times, the reference depth.

Because a cooling channel 14 in the first portion 5 as shown in FIGS. 2 and 3 provides a section of reduced mechanical strength, even though deformation of the wall 19 would be resisted by the presence of cooling water in the channel 14, it is preferable to have the current carrying metal immediately contact the second portion 6. Accordingly, it is preferable that the embodiment of FIGS. 1–3 modified as indicated in FIGS. 4–6, the so-modified embodiments also reducing the amount of high conductivity metal required.

As shown in FIG. 4, which illustrates only part of a coil, the first portion 5*g* is solid throughout and the second portion 6*b* has a pair of cooling channels 14*b* and 14*c* therein.

FIG. 5 is similar to FIG. 4 but shows a pair of differently shaped cooling channels 14*d* and 14*e* in the second portion 6*c* and a shaped end 24 on the first portion 5*h* for providing current concentration in the metal part to be heated.

FIG. 6 is similar to FIG. 4 but shows a cooling channel 14*f* in a different portion of the second portion 6*d*.

FIGS. 9 and 10 illustrate an embodiment of a multi-turn coil comprising a first portion 25 made of tubing of high conductivity metal, such as copper, and a second portion 26 made of tubing of a lower conductivity metal, such as steel, having a higher Young's Modulus than the metal of the first portion 25. Cooling fluid passes through the central opening 27 in the second portion 26. The mechanical and electrical considerations are the same as those described in connection with the preceding Figures, that is, the radial thickness of the portion 25 is at least equal to the reference depth of the current in the metal of the portion 25 and, preferably, is from one-and-one-half to ten times the reference depth and the dimensions and Young's Modulus of the metal of the portion 26 are such that the coil will not be deformed to the extent that it will have a short life when the coil is in use.

FIGS. 11–14 illustrate a further embodiment of a multi-turn coil which is made from a plurality of segments 28, 29 and 30 electrically and mechanically connected together by blocks 31 and 32 of high conductivity metal to which the segments may be secured by brazing. Each segment comprises a first portion, 33, 34 and 35, of high electrical conductivity metal, such as copper, and has a narrow spacing 36, 37 and 38, between its ends, each segment being an almost closed ring. Mechanical reenforcement of each first portion 33–35 is provided by C-shaped second portions, 39, 40 and 41, of lower electrical conductivity metal, such as steel. The constructional considerations for the coil are the same as those for the coils previously described.

The coil shown in FIGS. 11–14 has a pair of terminals 42 and 43 for connecting the coil to a current source, such as the source 4 shown in FIG. 1.

The coils illustrated in FIGS. 1–14 are intended to extend around a part to be treated, but the principles of the invention are equally applicable to coils intended to be disposed internally of a part to be treated. FIGS. 15–19 show coils of which are constructed in accordance with the principles of the invention and which may be disposed internally of a metal part *7b* to be treated.

The coil 45 illustrated in FIGS. 15–17 comprises a C-shaped, almost complete, machined ring 46 of high conductivity metal, such as copper. The ring 46 is U-shaped in cross-section, and the outer portion 47, nearest the part *7b*, has a radial thickness at least equal to the reference depth of the current and preferably, is about 1.5 to ten times the reference depth. The thicknesses of the remainder of the ring 46 is determined by the electrical losses which may be accepted, but preferably, the thicknesses are about 1.5 times the reference depth. The ends of the ring 46 are connected, such as by brazing, to hollow leads 48 and 49 of high conductivity metal preferably having a wall thickness of at least 1.5 times the reference depth.

A C-shaped member 50 of a metal having a Young's Modulus at least 20% greater than copper, e.g. steel, is disposed internally of the ring 46, as shown, with its peripherally outer surface engaging and closely fitting inner surface of the portion 47. This member 50 has a cross-section at its ends which permits cooling water, supplied through the leads 48 and 49, to enter the ring 46 through openings therein, such as the opening 51 shown in FIG. 17. The open side of the ring 46 is covered by a cover 52 of high conductivity metal preferably having a thickness of about 1.5 times the reference depth. The cover 52 is conductively connected to the ring 46, such as by brazing.

Because the leads 48 and 49 are subjected to forces forcing them apart during the flow of current, they should be braced to prevent distortion. They may, for example, be braced by a plurality of clamps 53 of insulating material.

The internal coil 54 illustrated in FIGS. 18 and 19 comprises a thick-walled tube 54 of a high strength metal, such as steel, which is covered by a high conductivity metal 55 such as copper, having a thickness at least equal to the reference depth of the current to be carried by the coil 54 and preferably, about 1.5 times such reference depth. The tube 54 may be bent to the desired shape and then, plated with the metal 55 or, alternatively, if the metal 55 is sufficiently ductile, it may be applied to the tube 54 prior to the bending thereof.

Although coils having only a single turn have been illustrated in FIGS. 15–19, it will be apparent to those skilled in the art that multiple turn coils may be similarly constructed.

Although preferred embodiments of the present invention have been illustrated and described, it will be apparent to those skilled in the art that various modifications may be made without departing from the principles of the invention.

The embodiments of the invention in which an exclusive property or privilege is claimed are defined as follows:

1. In apparatus for heating or forming a metal part by magnetically inducing an electric current in said metal part of sufficient magnitude to heat or form said part with a coil adjacent said part and connected to a source of electrical current having a predetermined frequency and having a current capacity sufficient to provide to the coil a current of a magnitude sufficient to induce said first-mentioned current in said part, said coil having a first metal portion and a second metal portion and having at least a part of said first portion intermediate said second portion and said metal part, said first portion being made of a relatively high electrical conductivity metal and being electrically connected to said source thereby to cause the current of said source to flow in said part of said first portion, said part of said first portion being deformable by the magnetic field produced by the current flowing therein in the absence of said second metal portion, and said second portion being made of a metal having an electrical conductivity less than the electrical conductivity of copper and having a Young's Modulus at least 20% greater than the Young's Modulus of the metal of said first portion and said second portion engaging said part of said first portion for resisting deformation of said last-mentioned part during the passage of current through said coil, and said part of said first portion intermediate said second portion and said metal part having a thickness at least equal to the reference depth of said current in said metal of said first portion.

2. Apparatus as set forth in claim 1 wherein said part of said first portion has a thickness from one to ten times said reference depth.

3. Apparatus as set forth in claim 1 wherein said part of said first portion has a thickness from 1.5 to ten times said reference depth.

4. Apparatus as set forth in claim 1 wherein said coil has an opening defined by said part of said first portion and wherein said metal part is in said opening.

5. Apparatus as set forth in claim 1 wherein said metal part is hollow and said coil is at least partly inside said metal part.

6. Apparatus as set forth in claim 1 wherein said first portion also extends over said second portion from the opposite ends of said part of said first portion.

7. Apparatus as set forth in claim 1 wherein one of said first and said second portion has a channel therein for receiving and circulating a cooling fluid in said coil.

8. Apparatus as set forth in claim 7 wherein said second portion has said channel therein.

9. Apparatus as set forth in claim 1 wherein said second portion engages said part of said first portion over the major part of the surface thereof facing away from said metal part.

10. In apparatus for heating or forming a metal part by magnetically including a current in said metal part of sufficient magnitude to heat or form said part and having a coil with an opening therein receiving said part and a source of current connected to said coil, said current being of a predetermined frequency, and said source having a current capacity sufficient to provide to the coil a current of a magnitude sufficient to induce said first-mentioned current in said part, said coil comprising a first portion made of a relatively high electrical conductivity metal and having a pair of ends connected to said source, at least part of said first portion extending at least substantially around and defining said opening and having a thickness radially outwardly of said opening at least equal to the reference depth of said current in said metal at said frequency, and said coil having a second portion engaging the side of said part of said first portion opposite from the side thereof defining said opening the current of said source flowing in said part of said first portion and said part of said first portion being deformable by the magnetic field produced by the current flowing therein in the absence of said second portion, said second portion extending around most of said opening for resisting deformation of said part of said first portion during the passage of current through said coil, said second portion being made of a metal different from the metal of said first portion and having both an electrical conductivity less than the electrical conductivity of copper and a Young's Modulus at least 20% greater than the Young's Modulus of the metal of said first portion.

11. Apparatus as set forth in claim 6 wherein said part of said first portion forms the radially inward bottom of a U-shaped channel in said first portion which extends circumferentially of said opening, metal of said first portion also forming side walls of said channel which extend radially and circumferentially of said opening, and said second portion of said coil being received in said channel with said side walls extending over axially opposite surfaces of said second portion.

12. Apparatus as set forth in claim 11 wherein one of said first portion and of said second portion has a cooling fluid channel therein for receiving and circulating a cooling fluid in said coil.

13. Apparatus as set forth in claim 12 wherein said cooling fluid channel is in said second portion.

* * * * *

UNITED STATES PATENT AND TRADEMARK OFFICE

CERTIFICATE OF CORRECTION

PATENT NO. : 4,207,451
DATED : June 10, 1980
INVENTOR(S) : Chester A. Tudbury

It is certified that error appears in the above-identified patent and that said Letters Patent are hereby corrected as shown below:

Claim 10, line 2, "including" should read

--inducing--.

Signed and Sealed this

*Eighteenth* Day of *November 1980*

[SEAL]

*Attest:*

SIDNEY A. DIAMOND

*Attesting Officer*

*Commissioner of Patents and Trademarks*